US005560308A

United States Patent [19]

Eto

[11] Patent Number: 5,560,308

[45] Date of Patent: Oct. 1, 1996

[54] APPARATUS FOR PROCESSING PERIPHERAL SELVEDGES OF FABRIC

[75] Inventor: Hiroyuki Eto, Tokyo, Japan

[73] Assignee: Matsushita Industrial Co., Ltd., Osaka, Japan

[21] Appl. No.: 403,175

[22] Filed: Mar. 13, 1995

[30] Foreign Application Priority Data

Mar. 14, 1994 [JP] Japan ..... 6-082194
Dec. 27, 1994 [JP] Japan ..... 6-325837

[51] Int. Cl.[6] ..... D05B 21/00; D05B 35/10; D05B 19/00; D05B 37/04

[52] U.S. Cl. ..... 112/470.07; 112/470.33; 112/130; 112/153; 112/309; 112/DIG. 2

[58] Field of Search ..... 112/470.07, 470.01, 112/470.03, 470.33, 475.04, 308, 309, 318, 322, DIG. 2, 153, 470.05, 130, 2.1

[56] References Cited

U.S. PATENT DOCUMENTS 4,434,731 3/1984 Beisler ..... 112/318 X
4,498,404 2/1985 Sadeh ..... 112/DIG. 2 X
4,630,364 12/1986 Fyfe et al. ..... 112/470.33 X
4,838,186 6/1989 Resta et al. ..... 112/309 X
5,216,969 6/1993 Thomas ..... 112/470.07 X

*Primary Examiner*—Peter Nerbun
*Attorney, Agent, or Firm*—Wenderoth, Lind & Ponack

[57] ABSTRACT

An apparatus is provided for processing peripheral selvedges of fabric. The apparatus includes a sewing machine unit for sewing up fabrics; an air table mechanism incorporating a number of jet apertures through which air is jetted onto an upper surface of the table in an obliquely upward direction towards a product guide member; a supplementary roller unit which vertically ascends and descends to shift a processable fabric synchronously with feeding of the sewing machine unit; a rotating unit having a fabric holding unit which descends only when sewing of a fabric corner is executed in order to hold and rotate the objective fabric by a predetermined angle and then ascends after rotating the fabric by a predetermined angle; a flange strip supply unit for supplying a flange strip to the sewing machine unit; and a controller unit for integrally controlling operation of the above component units. The flange strip supply unit includes a feed roller driven by a motor, a rotatable pressing roller, a cutter unit, and a pressing unit for pressing both sides of the flange strip fed from the flange supply unit by centering the flange strip around a travelling line of the cutter.

18 Claims, 6 Drawing Sheets

APPARATUS FOR PROCESSING PERIPHERAL SELVEDGES OF FABRIC

BACKGROUND OF THE INVENTION

The present invention relates to an apparatus for processing peripheral selvedges of fabrics such as darning of selvedges of a fabric, sewing to fix flange and selvedge tape to a sizeable mattress panel fabric, a bed spread, a mattress or a quilt, for example.

According to conventional practice, peripheral selvedges of any sizeable fabric such as a mattress panel fabric, a bed spread, a mattress or a quilt, have been processed via sewing. To implement sewing of peripheral selvedges, a supplementary table and a belt conveyer are installed to the left of a sewing machine before processing peripheral selvedges of an objective fabric in order to provide a flange or a pipe by manually shifting a processable fabric placed on the supplementary table along curves of the peripheral portions of the fabric.

Whenever processing peripheral selvedges of a fabric via the conventional technique, sewing operators necessarily shift the fabric placed on a supplementary table along curves of peripheral selvedges of the fabric. In order to properly follow up fabric-shifting operation, each operator needs to exert concentrative care and skilled technique in the processing of peripheral selvedges of fabric, and yet, the work not only consumes much time and labor, but it also causes each operator to build up fatigue.

Since experience and skill are required to properly process peripheral selvedges of fabric, uneven finishes along peripheral selvedges of fabric results in the failure to produce uniform quality products, thus causing a problem.

This problem is particularly significant in the production of fabrics such as mattress panel fabrics, bed spreads, mattresses or quilts which have sizeable dimensions.

The invention has been proposed to fully solve the above problem. The object of the invention is to provide a novel apparatus for uniformly processing peripheral selvedges of fabrics, wherein the apparatus features outstanding capability to precisely process any sizeable fabric via simple operation.

SUMMARY OF THE INVENTION

To achieve the above object, the inventive apparatus for processing peripheral selvedges of a sizeable fabric comprises the following: a sewing machine unit for sewing up fabrics; an air table mechanism incorporating a number of jet apertures through which air is jetted onto an upper surface of the table in an obliquely upward direction towards a product guide member; a supplementary roller unit capable of vertically ascending and descending to shift a processable fabric synchronously with feeding of the sewing machine unit; a rotating unit having a fabric-holding plate which descends only when sewing of fabric corner is executed in order to hold and rotate the objective fabric by a predetermined angle and then ascends after rotating the fabric by a predetermined angle; a flange supply unit for supplying flange to the sewing machine unit; and a controller unit for integrally controlling operation of the above component units. The flange supply unit includes a feed roller driven by a motor, a rotatable pressing roller capable of being moved in a direction perpendicular to the flange strip by a pneumatic cylinder, a cutter unit, and a pressing unit for pressing both sides of a flange strip fed from the flange supply unit around a travelling line of the cutter.

In addition, the inventive apparatus has the following features: The center line of a rotary shaft of the rotating unit is perpendicular to the upper surface of the air table unit. The rotating unit is structured so that an interval between the center of the rotary shaft and a sewing needle of the sewing machine unit is substantially equal to the length between the center of curvature of a corner of the fabric and the peripheral edge thereof. The fabric-holding unit includes a pair of needle bars which are orthogonal to the rotary shaft and are capable of drawing a locus substantially parallel with the upper surface of the air table. A rotary disc is provided below the needle bars and at the bottom of the rotary shaft. The rotary disc of the fabric holding unit is provided with slip-proof finish on surfaces thereof which come into contact with the processable fabric.

In order to operate the inventive apparatus, initially, an objective fabric having selvedges is placed on the upper surface of the air table. Next, in response to a drive signal from the controller unit, air is jetted out of jet apertures of the air table to cause the processable fabric to be slightly afloat above the upper surface of the air table and generate minimum friction against the upper surface thereof.

Since air is jetted out of the jet apertures in the obliquely upward direction towards the product guide member, the processable fabric is slightly urged towards the product guide member. Next, a flange strip is supplied to the sewing machine unit from the flange supply unit. Simultaneously, the supplementary feed roller is lowered to cause the roller to come into contact with the upper surface of the fabric. While this condition is present, the roller is rotated in accordance with a feeding amount of the sewing machine.

Simultaneously, the flange strip is supplied to peripheral edges of the fabric from the flange supply unit and then sewn to linear peripheral edges of the fabric so that overlocked sewing can be effected at the same time to execute processing of the fabric.

After processing linear peripheral edges of the fabric, processed peripheral edges respectively turn into corner portions of the fabric, and then, the fabric holding unit of the rotary unit descends to securely hold the upper surface of the fabric.

Next, while the rotary unit is rotated in accordance with feeding amount of the sewing machine so that the fabric can be rotated as well, in the same way as was done for the linear peripheral portions, selvedge corner portions of the fabric are also processed.

Immediately after completing processing of the selvedges by sewing flange strip to corner portions of the fabric, the fabric holding unit of the rotary unit ascends to leave the upper surface of the fabric. Simultaneously, the supplementary feed roller unit descends to bring the roller into contact with the upper surface of the fabric and then processes peripheral edges of the linear portions.

Edges of the linear and corner portions are repeatedly processed to permit supply of the flange strip to peripheral edges of the fabric in order that they can be integrally be sewn. After completing the sewing operation, the flange strip thus far continuously supplied is then cut off by the cutter at a predetermined length. Finally, a terminal portion of the flange strip is sewn together with peripheral edges of the fabric, thus fully completing the processing of the peripheral selvedges of the fabric.

DETAILED DESCRIPTION OF THE PREFERRED EMBODIMENTS

Referring now to the accompanying drawings, details of the peripheral selvedge processing apparatus according to the invention are described below.

Figure 1:
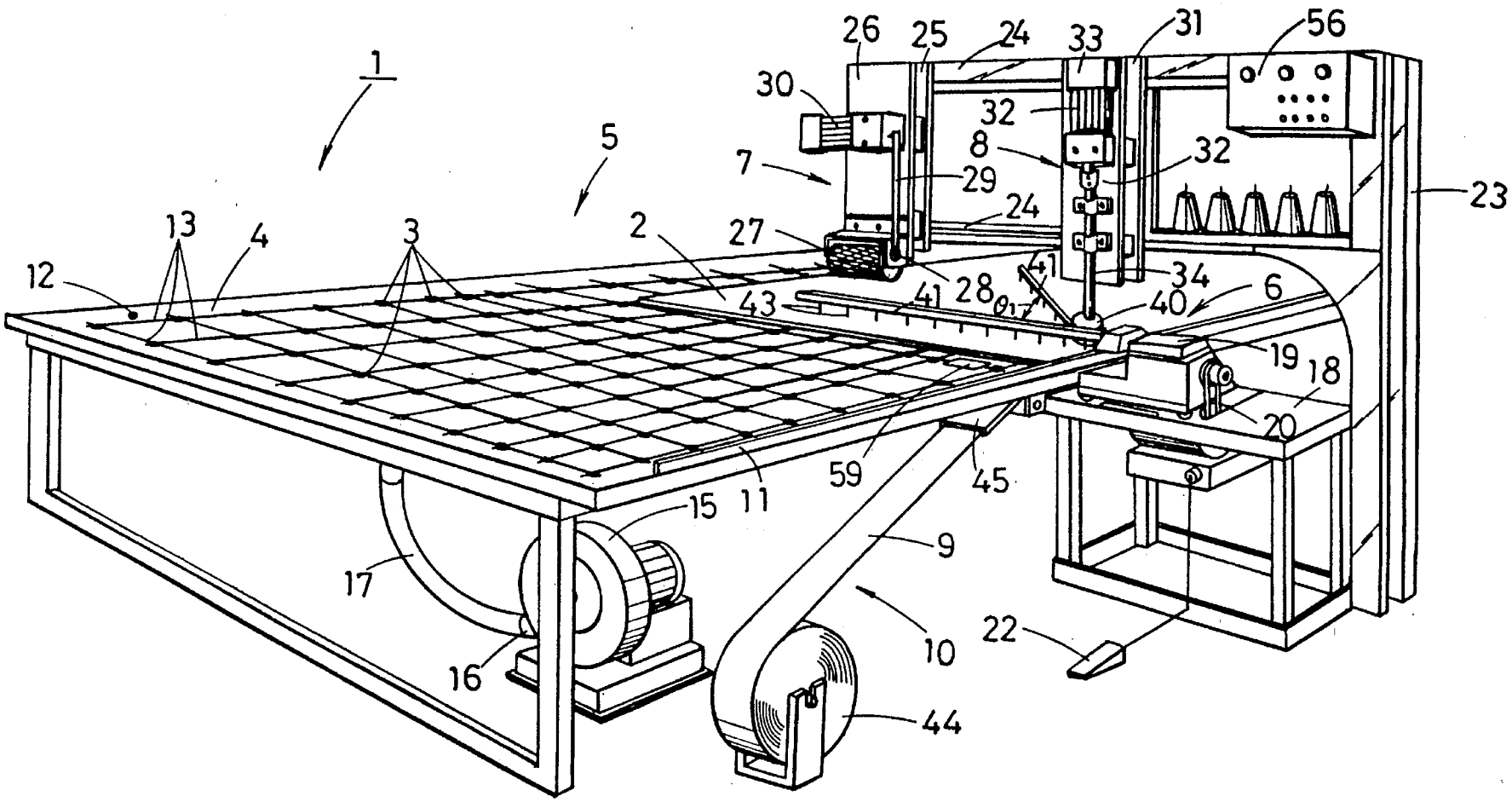
FIG. 1 is an overall perspective view of the inventive apparatus for processing peripheral selvedges of a fabric.

FIG. 1 is an overall perspective view of the peripheral selvedge processing apparatus according to the invention, in which the reference numeral 1 designates the whole of the inventive apparatus.

The inventive peripheral selvedge processing apparatus 1 comprises the following: an air table mechanism 5 comprising an air table 4 incorporating a number of air-jetting apertures 3 for jetting air to cause an objective fabric 2 mounted thereon to slightly float so that frictional resistance can be minimized; a sewing machine unit 6 installed to a side of the air table mechanism 5; a supplementary fabric shifting roller unit 7 and a rotary (or fabric rotating) unit 8 for feeding peripheral selvedges of the fabric 2 to the sewing machine unit 6; and a flange supply unit 10 installed below the air table 4 in order to feed a flange (or a flange strip) to the sewing machine unit 6.

Figure 2:
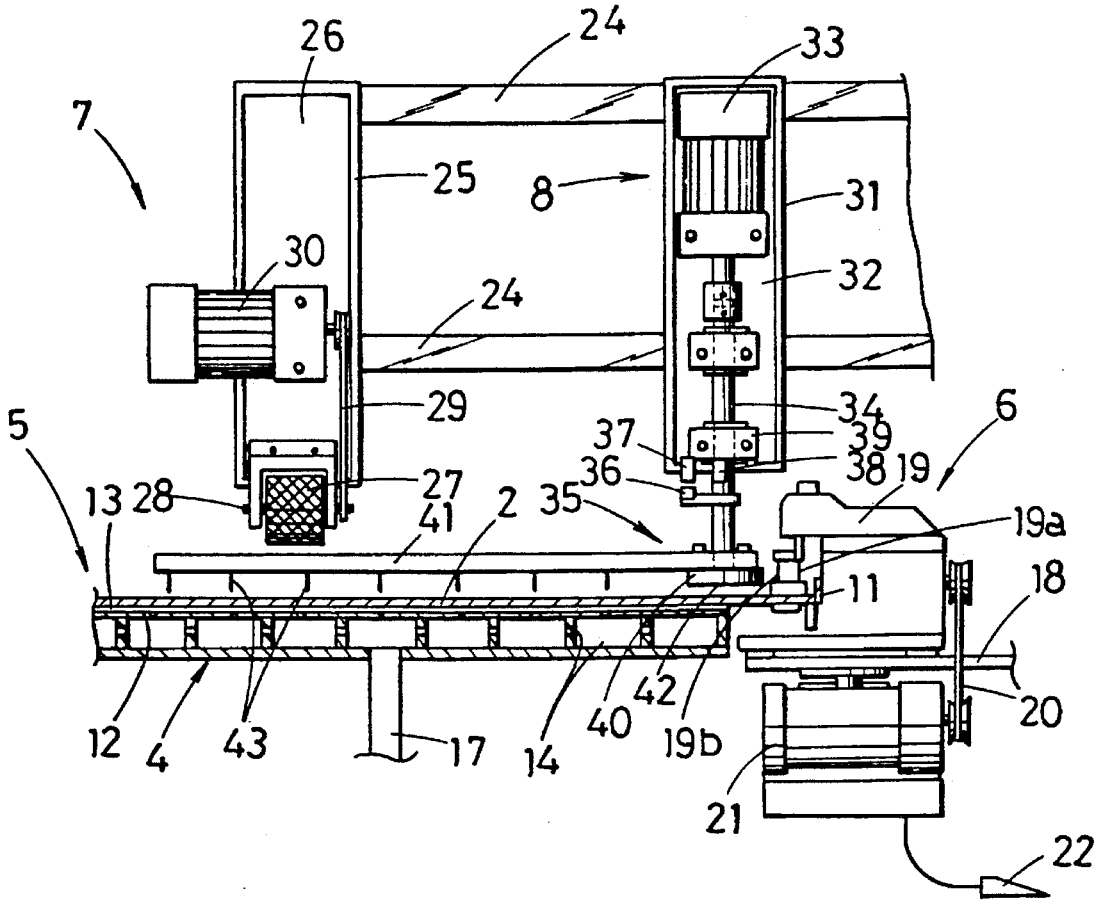
FIG. 2 is a partially exposed enlarged sectional view of essential components of the apparatus according to the invention.
Figure 3:
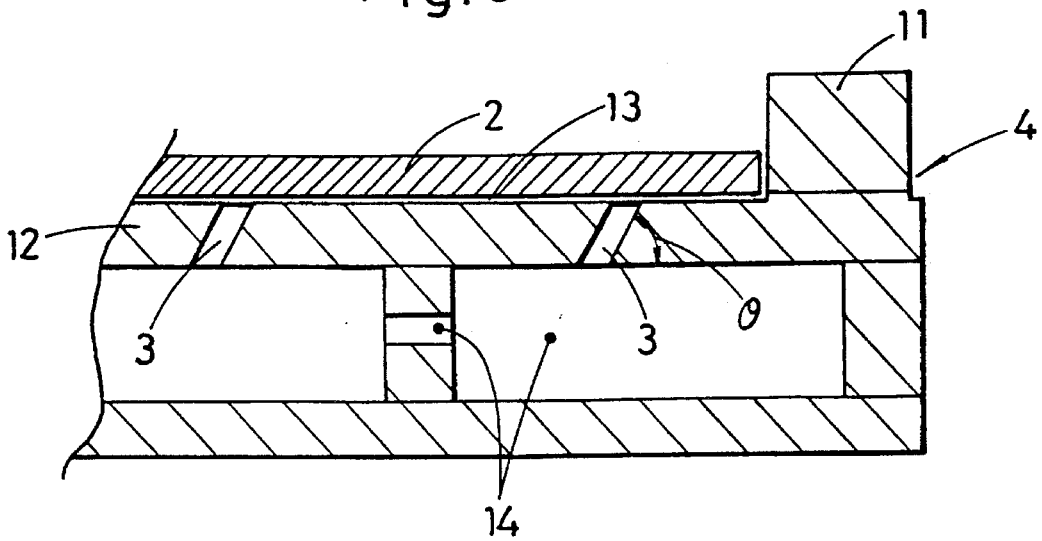
FIG. 3 is an enlarged sectional view of the air table mechanism of the apparatus according to the invention.

As shown in FIG. 1 through FIG. 3, the air table mechanism 5 incorporates a plurality of the air-jetting fine apertures 3 respectively penetrating a surface panel 12 of the air table 4 so that air can be jetted in an obliquely upward direction towards a guide plate member (or fabric guide member) 11 erected on the side of the sewing machine unit 6 of the air table 4. Angle θ of respective air-jetting fine apertures 3 is determined in a range from 80 degrees to 45 degrees depending on the weight and the fluff of the processable fabric 2. Diameter of respective air-jetting apertures 3 is determined according to the kind of the processable fabric.

A number of lattice-like air grooves 13 are formed in superficial aperture portions of respective air-jetting apertures 3 on the surface of the air table 4. These air grooves 13 respectively cause air jetted out of the air-jetting apertures 3 to be dispersed in order that the fabric 2 placed on the air table 4 can uniformly float above the air table 4.

Bottom portions of respective air-jetting apertures 3 are interconnected to air passage 14 formed below the surface panel 12 of the air table 4, and the air passage 14 is connected to an air supply duct 16 of a blower 15 installed below the air table 4 via air supply pipe 17.

A sewing machine head 19 of the sewing machine unit 6 is releasably mounted to an upper surface of a mounting table 18 installed on a side of the air table mechanism 5. The head 19 is driven by a drive motor 21 secured below the mounting table 18 via a drive belt 20, and the drive motor 21 is turned ON and OFF via a foot switch 22.

The sewing machine head 19 provided for the sewing machine unit 6 shown in FIG. 1 and FIG. 2 incorporates an overlock sewing needle **19*a* and a flange sewing needle 19*b*. In other words, this is an interlock machine head 19 capable of simultaneously executing overlocking and flange sewing operations. According to use, the interlock machine head 19 can be replaced with an overlock machine head or a taping machine head 19 shown in FIG. 7 or such a unit provided with a desired sewing machine head in conjunction with the mount table 18**.

As shown in FIG. 1 and FIG. 2, the supplementary roller unit 7 for feeding peripheral selvedges of the fabric 2 to the sewing machine unit 6 has a support frame 24 horizontally extended in the widthwise direction (left-right direction shown in FIG. 2) of the air table 4 from a strut 23 erected on the side of the air table 4. The support frame 24 is provided with a substrate 25 which is slidably installed in the widthwise direction of the air table 4 and a roller elevating plate 26 which is vertically movable by a pneumatic cylinder (not shown). A supplementary feed roller 27 is rotatably set to bottom portion of the roller elevating plate 26, where a shaft 28 of the supplementary feed roller 27 is rotated by a drive servo motor 30 via a belt 29 so that feeding speed of the supplementary feed roller 27 can be equal to sewing speed of the sewing machine unit 6. In accordance with dimensions of the fabric 2, the substrate 25 causes the supplementary feed roller 27 to shift its position for pressing the fabric 2 by slidably moving the support frame 24.

As shown in FIG. 1 and FIG. 2, the apparatus 1 can properly deal with fabrics of varied dimensions merely by elongating the width of the supplementary feed roller 27. A built-in type drive roller (not shown) is installed in surface portions of the air table 4 at the position right below the supplementary feed roller 27. It is also effective to feed the fabric 2 nipped between the built-in drive roller and the supplementary feed roller 27 by driving the built-in drive roller via a servo motor.

As shown in FIG. 1 and FIG. 2, the rotary unit 8 for rotating the fabric 2 along corner portions of the fabric 2 is provided with a pivotal support frame 31 which is slidably mounted to the horizontal support frame 24 (linked with the substrate 25 of the supplementary roller unit 7) in the widthwise direction of the air table 4. A fabric-holder elevating plate 32 is installed on the pivotal support plate 31 so that the elevating plate 32 can be moved vertically by a pneumatic cylinder (not shown). The fabric-holder elevating plate 32 accommodates a servo motor 33 for rotating a vertically erected rotary shaft 34, the vertical rotary shaft 34, and a fabric holder 35 mounted to the bottom end of the vertical rotary shaft 34. The fabric-holder elevating plate, rotary shaft and fabric holder can be referred to together as a fabric holder unit. Distance between the vertical rotary shaft 34 and the sewing needle **19*a* of the sewing machine unit 6 can be arranged so that it can be subtantially equal to the length between the center of curvature of a corner portion of the fabric 2** and peripheral edges thereof.

A rotary piece 36 is provided at a position close to the fabric holder 35 right below the vertical rotary shaft 34. A stationary position sensor 37 and a rotating position sensor 38 respectively detecting the actual position of the rotary piece 36 are individually mounted to the fabric-holder elevating plate 32 which is a stationary member and a lower pillow block bearing 39 supporting the vertical rotary shaft 34.

Figure 4:
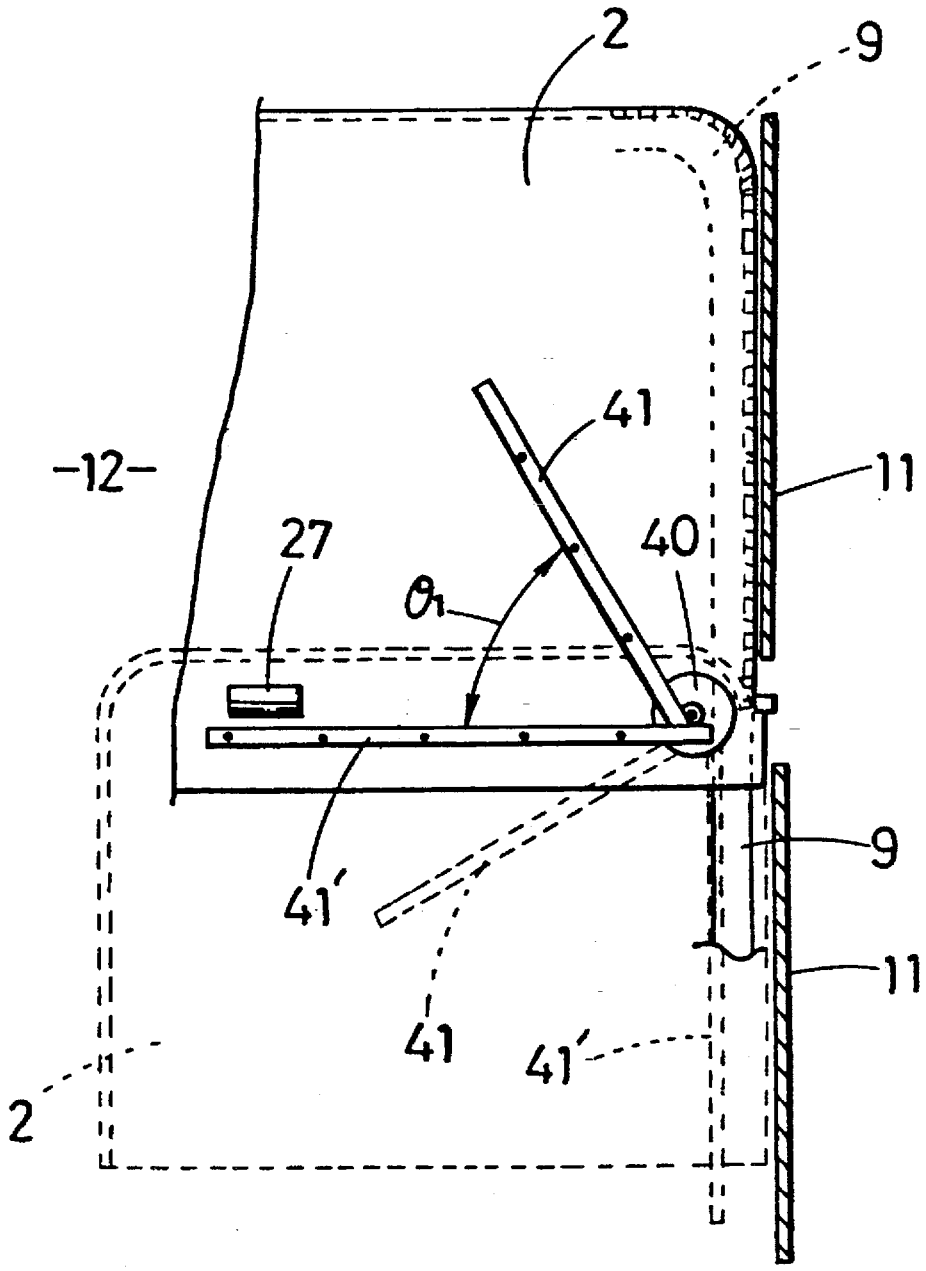
FIG. 4 is a plan view showing an operative condition of the inventive apparatus while processing linear and corner portions near the corners of a fabric.

A rotary disc 40 is mounted to bottom end of the vertical rotary shaft 34 across the fabric holder 35. As shown in FIG. 4, a pair of needle bars 41 (or fabric engaging bars) and 41 joint forming there between a predetermined angle θ1 of less than 45 degrees are respectively extended from the rotary disc 40. Slip-proof finish 42 is effected over the bottom surface of the rotary disc 40 via a knurling tool and also over the bottom surfaces of the needle bars 41 and 41' by providing a plurality of downwardly extending needles 43.

It is of course possible to provide the slip-proof finish 42 by adhering needle cloth, sand paper, rubber, or the like, to the bottom surface of the rotary disc 40 in place of using the knurling tool.

Figure 5:
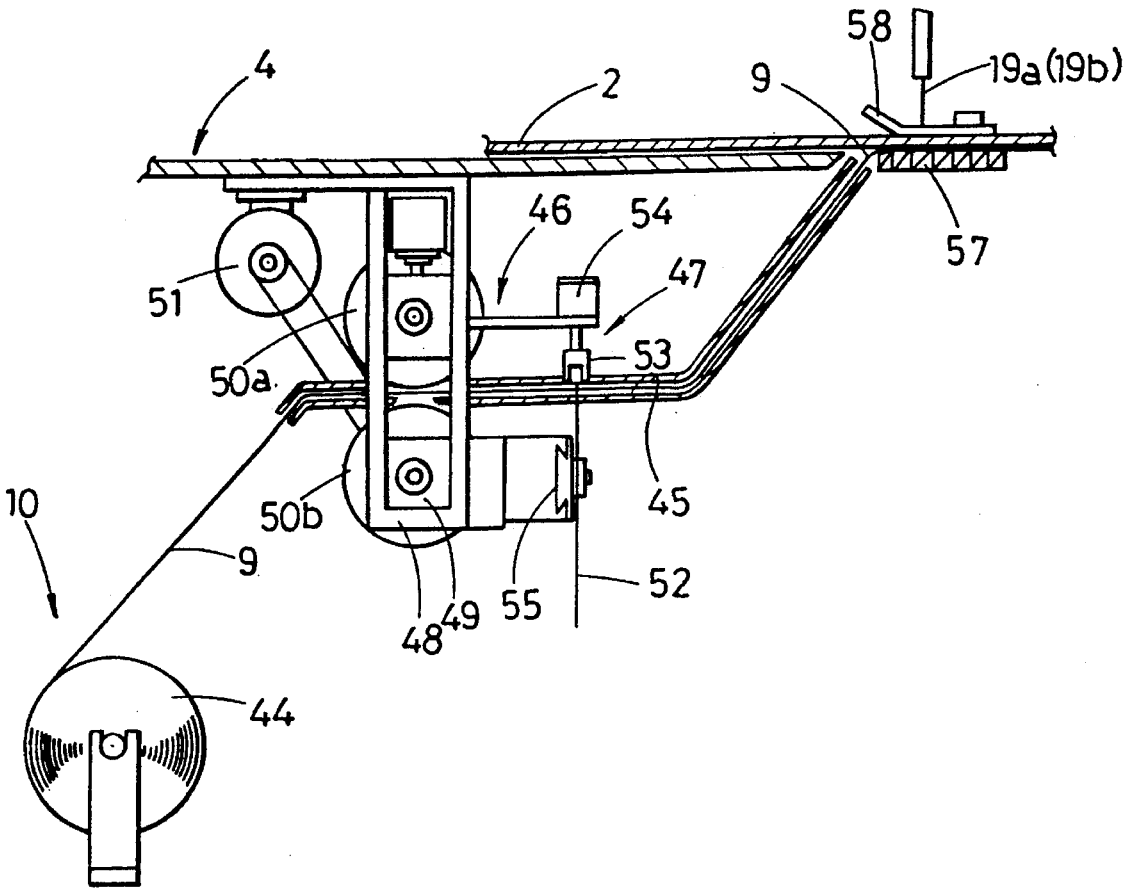
FIG. 5 is a lateral view of the flange supply unit showing an operative condition while supplying flange to the head portion of the sewing machine according to the invention.

As shown in FIG. 1 and FIG. 5, the flange supply unit 10 provided below the air table 4 rotatably supports a narrow-width coiled flange reel 44 below the air table 4 in order to feed a flange (flange material) 9 unwound from the reel 44 to the sewing machine head 19 via a supply passage 45 which accommodates a flange delivery unit 46 and a cutter unit 47 for cutting off the supplied flange.

The flange delivery unit 46 is provided with a pair of square frames 48 and 48 which are downwardly extended from both sides of the air table 4. A pair of rollers **50*a* and 50*b* having both ends of their respective shafts held by a pair of bearings 49 and 49 which are slidable inside of the square frames 48 and 48 are mounted in upper and lower positions for nipping the flange 9 therebetween. The upper roller constitutes pressing roller 50*a*, and the lower roller constitutes a forwarding roller 50*b* which is driven by a forwarding drive motor 51**.

The cutter unit 47 comprises the following: a disc-shaped cutter 52 rotated by a cutter drive motor (not shown) secured to the square frames 48 at a position downstream of the flange delivery unit 46, a forked pressing tool 53 for pressing the flange 9 in front and on the back of the cutter 52, and a pneumatic cylinder 54 for lifting and lowering the forked pressing tool 53. The cutter 52 is movable in the widthwise direction of the air table 4 via a dovetail-groove type slider 55.

It is also possible to introduce a flat cutter knife instead of using the disc-shaped cutter 52 driven by a cutter drive motor.

Those interlinked movements described above are executed via integral drive control operations of the controller unit 56 (secured between the strut 23 erected on the side of the air table 4 and the horizontally extended support frame 24) for controlling sequential operations of the inventive apparatus 1 described below.

The reference numeral 57 shown in FIG. 5 designates forwarding teeth provided for the sewing machine head 19 and the reference numeral 58 designates a fabric-edge pressing tool, whereas the reference numeral 59 shown in FIG. 1 designates a sensor for detecting edges of the fabric 2.

Next, integral operations of the inventive apparatus 1 for processing peripheral selvedges of the fabric 2 are described below.

First, a fabric 2 subject to processing of peripheral edges is placed on the upper surface of the air table 4. Next, operation of the controller unit 56 is activated to cause air (pressurized by the blower 15 of the air table mechanism 5) to be jetted out of the air-jetting apertures 16 to slightly float the fabric 2 above the surface panel 12 of the air table 4. While maintaining a condition in which friction between the fabric 2 and the surface panel 12 of the air table 4 is minimized, peripheral edges of the fabric 2 are slightly pressed and moved in the direction of the guide member 11, and then an edge of the fabric 2 is nipped between the forwarding teeth 57 of the sewing machine head 19 and the fabric-edge pressing tool 58.

Next, the foot switch 22 is turned ON. In response to the activating signal, the controller unit 56 activates operation of a pneumatic cylinder of the supplementary roller unit 7 to cause the roller elevating plate 26 to descend to bring the supplementary feed roller 27 into contact with the upper surface of the fabric 2.

Figure 6:
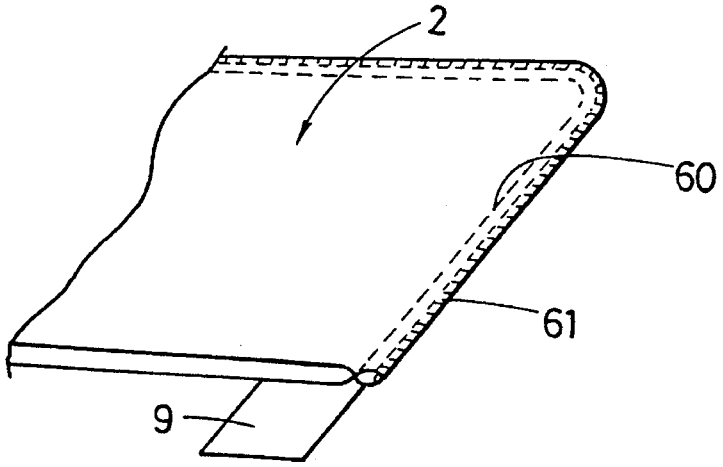
FIG. 6 is a partially exposed perspective view of a fabric having flange being sewn together simultaneous with overlocking executed by the peripheral selvedge processing apparatus according to the invention.

Simultaneous with the contact of the supplementary feed roller 27 with upper surface of the fabric 2, the servo motor 30 of the supplementary feed roller unit 7, the drive motor 21 of the sewing machine head 6, and the flange-forwarding drive motor 51 of the flange supply unit 10, are respectively turned ON to enable the sewing machine head 19 to perform a sewing operation at a speed identical to the forwarding speed of the supplementary roller 27 of the supplementary feed roller unit 7. Simultaneously, flange 9 unwound from the flange reel 44 is delivered to the sewing machine head 19 via the supply passage 45. When the flange 9 is fully sewn on linear peripheral edges of the fabric 2, processing of the peripheral selvedges is completed. Next, as shown in FIG. 6, simultaneous with completion of sewing the flange 9 along the peripheral selvedges of the fabric 2 via flange sewing line 60, the peripheral selvedges enter into the overlocked condition 61.

In this way, simultaneous with the sewing of the flange 9 along linear portions of peripheral edges of the fabric 2, peripheral edges are overlocked to complete a selvedge processing operation. When a corner portion of the fabric 2 is processed, the fabric-edge sensor 59 mounted to the upper surface of the air table 4 detects an edge portion of the fabric 2 and transmits an edge-detection signal to the controller unit 56.

As soon as the fabric-edge detection signal is received by the controller unit 56, a pneumatic cylinder of the supplementary roller unit 7 lifts the roller elevating plate 26 to cause the supplementary feed roller 27 to leave the upper surface of the fabric 2.

Simultaneous with departure of the supplementary feed roller 27 from the upper surface of the fabric 2, a pneumatic cylinder of the rotary unit 8 lowers the fabric-holder elevating plate 32 to cause the rotary disc 40 and the needle bars 41' and 41' to respectively come into contact with the upper surface of the fabric 2, and then enables them to securely hold the fabric 2 by means of the slip-proof finish 42.

Simultaneous with retention of the fabric 2 by the rotary disc 40 and the needle bars 41 and 41' of the servo motor 33 of the rotary unit 8 is activated to permit the flange 9 to be sewn along peripheral edges of the corner portion of the fabric 2 by rotating the vertical rotary shaft 34 in order that the speed of supplying peripheral edges of the corner portion of the fabric 2 held by the rotary disc 40 and the needle bars 41 and 41' to the sewing machine head 19 the, flange-forwarding speed of the flange supply unit 10, and the speed of the sewing machine head 19 for sewing the flange 9, can be maintained exactly identical to each other.

As shown in FIG. 6, simultaneous with completion of the sewing of the flange 9 along the peripheral selvedge of corner the portion of the fabric via the flange sewing line 60, peripheral selvedges are overlocked (61), thus completing processing of the corner edge portion.

When the rotational of the vertical rotary shaft 34 is terminated, the pneumatic cylinder of the rotary unit 8 lifts the fabric-holder elevating plate 32 to cause the rotary disc 40 and the needle bars 41' and 41 to respectively leave the upper surface of the fabric 2. This in turn activates the pneumatic cylinder of the supplementary feed roller unit 7 to lower the roller elevating plate 26 to bring the supplementary feed roller 27 into contact with the upper surface of the fabric 2, and then, as soon as the flange 9 has been sewn along the linear portion mentioned above, the overlocking process is initiated.

Thenceforth, sewing of the flange 9 along the linear portion of the fabric 2 and the overlocking process executed simultaneous with the sewing operation, and sewing of the flange 9 along the corner portion and the overlocking process executed simultaneous with the sewing operation, are repeated as required before completing the whole selvedge process through which the flange 9 is sewn along peripheral selvedges of the fabric 2.

After completing the whole process for sewing the supplied flange 9 along all peripheral edges of the fabric 2, the sewing machine unit 6 and the supplementary feed roller 27 provisionally halt their operation to enable the forked pressing tool 53 of the cutter unit 47 to press the flange 9, and then the flange 9 is cut off when the disc cutter 52 (which keeps on rotating at an intermediate portion pressed by the forked pressing tool 53) is moved in the widthwise direction of the air table 4.

After the flange 9 has been cut off, the sewing machine unit 6 and the supplementary feed roller 27 resume their operation to permit the remaining portion of the cut-off flange 9 to be sewn along peripheral edges of the fabric 2 to fully complete processing of peripheral edges of the objective fabric 2. After terminating the operation of the apparatus 1 for processing peripheral selvedges of the fabric 2, the sewing operator removes the completed fabric product 2 from the air table 4 of the apparatus 1 to eventually complete the overall process for processing peripheral selvedges of the fabric 2.

Figure 7:
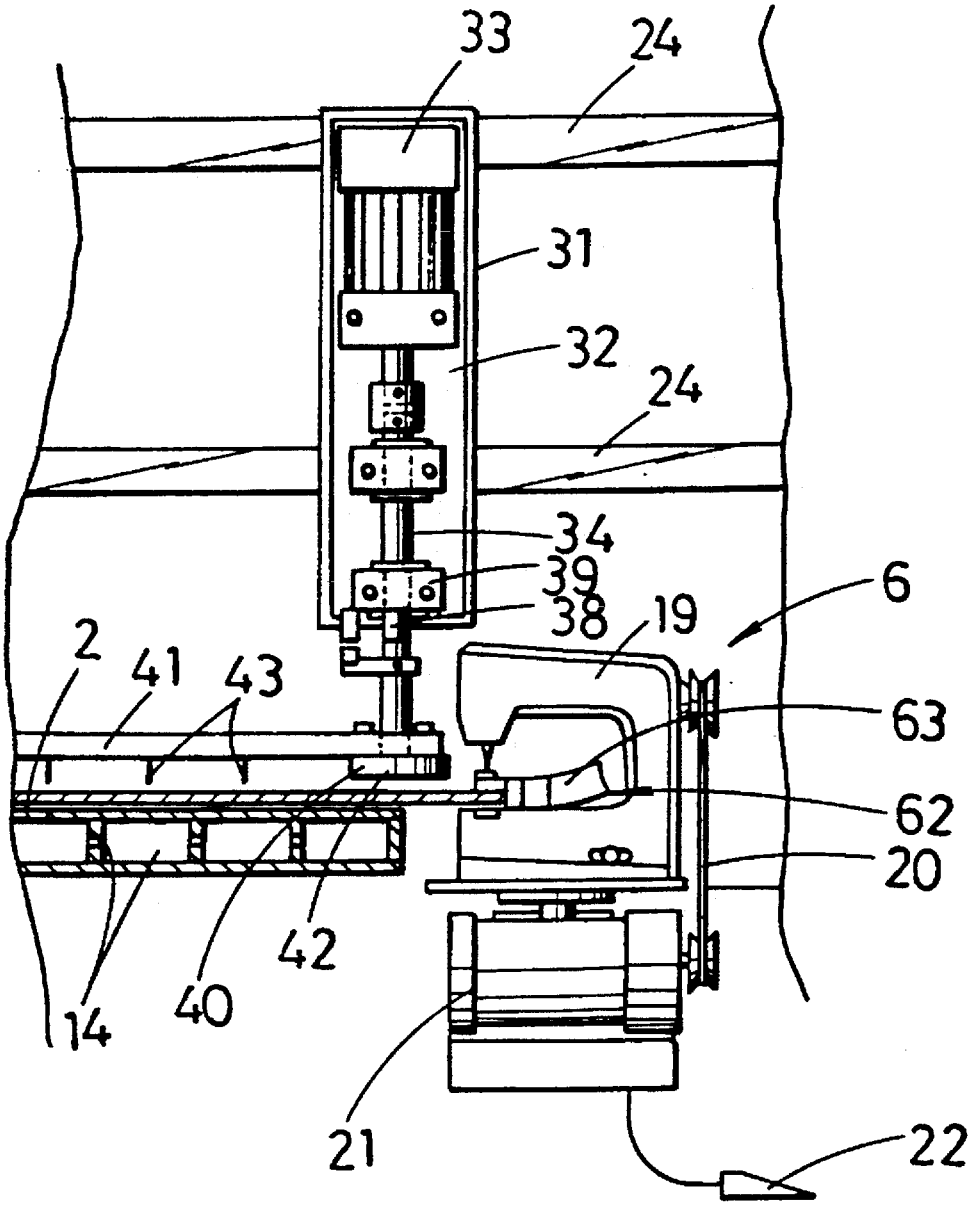
FIG. 7 is a partially exposed front view of a taping machine head provided for the peripheral selvedge processing apparatus according to the invention.
Figure 8:
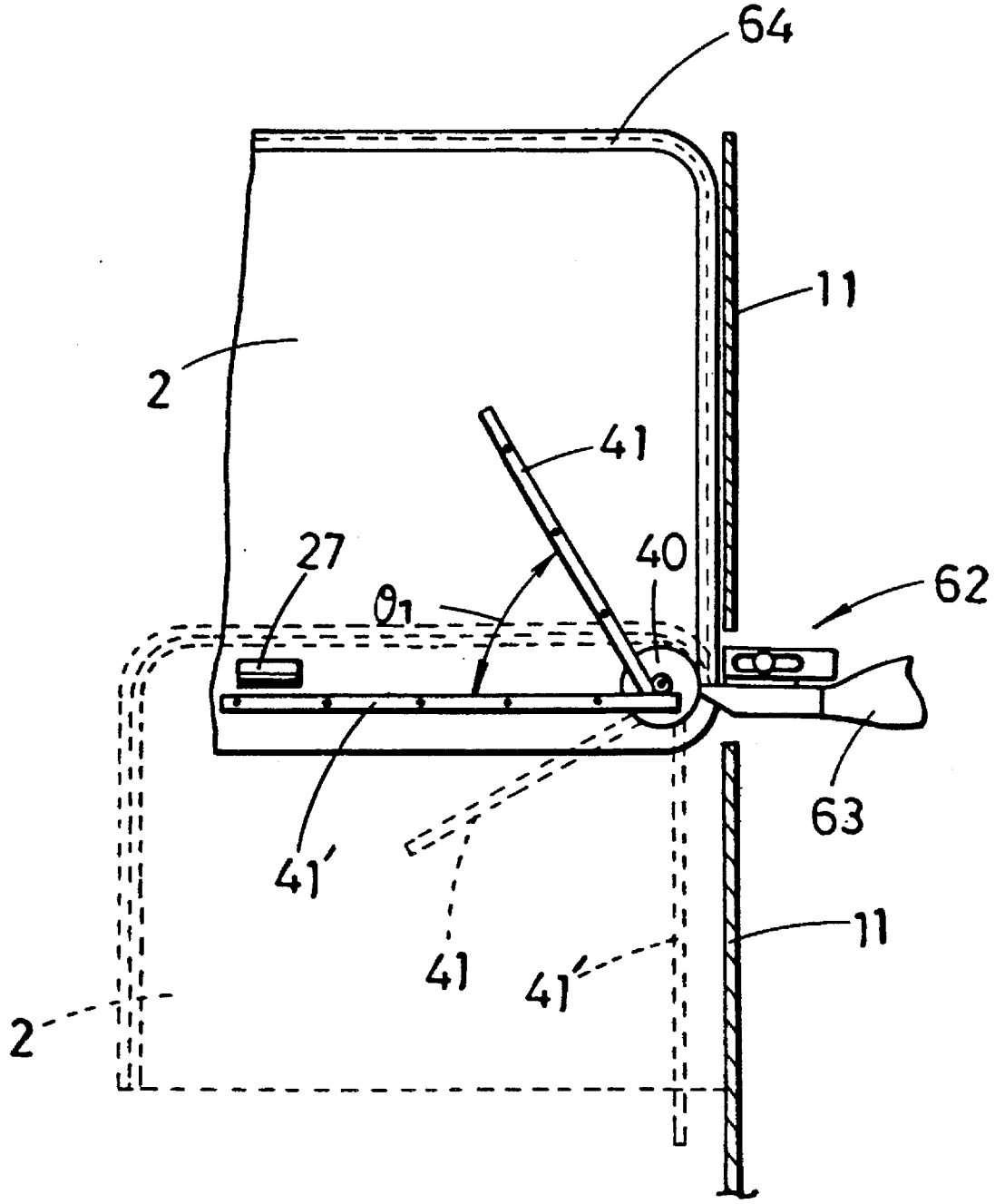
FIG. 8 is a plan view showing an operative condition while processing linear and corner portions near the corners of a taped fabric according to the invention.

In the event that the sewing machine head 19 of the sewing machine unit 6 consists of the taping machine head 19 shown in FIG. 7 for example, as shown in FIG. 8, peripheral edges of the fabric 2 are subject to a piping process with a tape 63 supplied from a tape supply unit 62 (detailed structure is not shown). Except for this difference, the inventive apparatus 1 functions in the same way as was described in the above embodiment.

What is claimed is:

1. An apparatus for processing peripheral selvedges of fabric, comprising:

an air table mechanism including a table having an upper surface with a plurality of air-jet apertures formed therethrough;

a fabric guide member mounted to said table;

a sewing machine unit mounted adjacent said table;

a supplementary fabric-shifting roller unit movably mounted relative to said table for movement toward and away from said upper surface of said table;

a fabric-rotating unit including a frame and a fabric-holding unit movably mounted to said frame for movement toward and away from said upper surface of said table;

a flange strip supply unit operably coupled to said sewing machine unit, said flange strip supply unit comprising a feed roller, a pressing roller confronting said feed roller so as to form a flange strip nipping region therebetween, and a flange strip cutter unit disposed along a flange strip supply path to said sewing machine unit; and wherein said air-jet apertures are directed in a direction oblique to said upper surface of said table, said direction slanting upwardly and toward said fabric guide member.

2. An apparatus as recited in claim 1, wherein said fabric-holding unit includes a rotary shaft having a rotation axis;

said rotation axis of said rotary shaft extends perpendicular to said upper surface of said table;

said sewing machine unit includes a sewing needle; and said rotation axis of said rotary shaft is offset, in a direction parallel to said upper surface of said table, from said sewing needle of said sewing machine unit.

3. An apparatus as recited in claim 2, wherein said fabric-holding unit further includes a pair of angularly offset fabric-engaging bars extending radially away from said rotary shaft and being parallel to said upper surface of said table.

4. An apparatus as recited in claim 1, wherein said fabric-holding unit includes a rotary shaft having a rotation axis, said rotation axis of said rotary shaft extending perpendicular to said upper surface of said table, a rotary disc having a rotation axis coincident with said rotation axis of said rotary shaft, and a pair of angularly offset fabric-engaging bars extending radially away from said rotary shaft and being parallel to said upper surface of said table.

5. An apparatus as recited in claim 4, wherein fabric contacting surfaces of said rotary disc and said pair of said fabric-engaging bars have slip-proof finishes.

6. An apparatus as recited in claim 5, wherein each of said slip-proof finishes of said fabric-engaging bars comprises a plurality of needles protruding downwardly from the respective fabric contacting surface of the respective fabric-engaging bar toward said upper surface of said table.

7. An apparatus as recited in claim 1, wherein said supplementary fabric-shifting roller unit is movably mounted relative to said table for movement in a direction perpendicular to said upper surface of said table.

8. An apparatus as recited in claim 1, wherein said fabric-holding unit of said fabric-rotating unit is movably mounted to said frame for movement in a direction perpendicular to said upper surface of said table.

9. An apparatus as recited in claim 1, further comprising a controller unit for integrally controlling operation of said air table mechanism, said sewing machine unit, said fabric-shifting roller unit, said fabric-rotating unit, and said flange strip supply unit.

10. An apparatus as recited in claim 1, wherein said flange strip cutter unit comprises a cutting blade movably mounted for movement across said flange strip supply path, and a pressing tool for pressing the flange strip against said cutting blade.

11. An apparatus as recited in claim 1, wherein said pressing tool comprises a forked pressing tool having tines on opposing sides of said cutting blade for pressing opposite sides of the flange strip around said cutting blade.

12. An apparatus for processing peripheral selvedges of fabric, comprising:

an air table mechanism including a table having an upper surface with a plurality of air-jet apertures formed therethrough;

a fabric guide member mounted to said table;

a sewing machine unit mounted adjacent said table;

a supplementary fabric-shifting roller unit movably mounted relative to said table for movement toward and away from said upper surface of said table;

a fabric-rotating unit including a frame and a fabric-holding unit movably mounted to said frame for movement toward and away from said upper surface of said table;

a flange strip supply unit operably coupled to said sewing machine unit, said flange strip supply unit comprising a feed roller, a pressing roller confronting said feed roller so as to form a flange strip nipping region therebetween, and a flange strip cutter unit disposed along a flange strip supply path to said sewing machine unit; and wherein said flange strip cutter unit comprises a cutting blade movably mounted for movement across said flange strip supply path, and a pressing tool for pressing a flange strip against said cutting blade.

13. An apparatus as recited in claim 12, wherein said pressing tool comprises a forked pressing tool having tines on opposing sides of said cutting blade for pressing opposite sides of the flange strip around said cutting blade.

14. An apparatus for processing peripheral selvedges of fabric, comprising:

an air table mechanism including a table having an upper surface with a plurality of air-jet apertures formed therethrough;

a fabric guide member mounted to said table;

a sewing machine unit mounted adjacent said table;

a supplementary fabric-shifting roller unit movably mounted relative to said table for movement toward and away from said upper surface of said table;

a fabric-rotating unit including a frame and a fabric-holding unit movably mounted to said frame for movement toward and away from said upper surface of said table;

a flange strip supply unit operably coupled to said sewing machine unit, said flange strip supply unit comprising a feed roller, a pressing roller confronting said feed roller so as to form a flange strip nipping region therebetween, and a flange strip cutter unit disposed along a flange strip supply path to said sewing machine unit; and wherein said fabric-holding unit includes a rotary shaft having a rotation axis, said rotation axis of said rotary shaft extending perpendicular to said upper surface of said table, and a pair of angularly offset fabric-engaging bars extending radially away from said rotary shaft and being parallel to said upper surface of said table.

15. An apparatus as recited in claim 14, wherein said fabric-holding unit further includes a rotary disc having a rotation axis coincident with said rotation axis of said rotary shaft.

16. An apparatus as recited in claim 15, wherein fabric contacting surfaces of said rotary disc and said fabric-engaging bars have slip-proof finishes, respectively.

17. An apparatus as recited in claim 16, wherein each of said slip-proof finishes of said fabric-engaging bars comprises a plurality of needles protruding downwardly from the respective fabric contacting surface of the respective fabric-engaging bar toward said upper surface of said table.

18. An apparatus as recited in claim 14, wherein said sewing machine unit includes a sewing needle; and said rotation axis of said rotary shaft is offset, in a direction parallel to said upper surface of said table, from said sewing needle of said sewing machine unit.

* * * * *